United States Patent [19]

Evans

[11] 4,438,852

[45] Mar. 27, 1984

[54] MODULAR DESK ORGANIZER AND ADAPTER THEREFOR

[75] Inventor: Donald L. Evans, Windsor, Wis.

[73] Assignee: Don Evans, Inc., DeForest, Wis.

[21] Appl. No.: 273,915

[22] Filed: Jun. 15, 1981

[51] Int. Cl.[3] ..... A47F 7/00

[52] U.S. Cl. ..... 211/11; D19/75; D19/90; D19/92; 108/114; 206/558; 220/234

[58] Field of Search ..... 211/10, 11, 126, 50; 206/558; D19/75, 90, 92; 220/4 C, 4 D, 23.2, 220/23.4, 23.83; 312/9, 111; 403/381, 406; 108/64, 108/114; 46/26, 31

[56] References Cited

U.S. PATENT DOCUMENTS

| | | | |
|---|---|---|---|
| 883,489 | 3/1908 | Schossow | 403/381 |
| 1,736,574 | 11/1929 | Binks | 211/11 |
| 2,023,150 | 12/1935 | Ritchie | 211/11 X |
| 2,164,133 | 6/1939 | Efron | 211/11 |
| 2,576,409 | 11/1951 | Michaelis et al. | 220/23.4 X |
| 2,751,088 | 6/1956 | Hargett | 211/11 X |
| 2,783,107 | 2/1957 | Gacht | 108/64 |
| 2,902,166 | 9/1959 | Bahr | 211/11 |
| 3,269,547 | 8/1966 | Chamberlin | 211/11 |
| 4,074,810 | 2/1978 | Juergens et al. | 211/126 X |

FOREIGN PATENT DOCUMENTS

| | | | |
|---|---|---|---|
| 1147625 | 4/1969 | United Kingdom | 108/64 |

*Primary Examiner*—J. Franklin Foss
*Assistant Examiner*—David L. Talbott
*Attorney, Agent, or Firm*—Isaksen, Lathrop, Esch, Hart & Clark

[57] ABSTRACT

A modular desk organizer is disclosed which includes a pair of organizing units (12, 14) joined into a common assembly by an adapter (16). The adapter (16) includes a pair of support shelves (32) having apertures (34) formed therein and positioned so that the adapter (16) can be securely attached to adjoining organizing units while ensuring that the organizing units are horizontally stable.

2 Claims, 4 Drawing Figures

MODULAR DESK ORGANIZER AND ADAPTER THEREFOR

TECHNICAL FIELD

This invention relates to organizers intended to aid with the organization of papers and files on an office desk and, in particular, to a multi-part modular organizer capable of handling papers or files of different sizes, thicknesses, and functions.

BACKGROUND OF THE INVENTION

The prior art is generally cognizant of the use of desk files and other desk organizers which are intended to be placed on an office desk so as to aid in the separation of papers and files and the organizing of the same. For example, U.S. Pat. Nos. 1,736,574 and 4,074,810 both disclose combination tray and file organizing devices which include specific structure so as to combine more than one type of filing or organizing device into a combined desk unit. U.S. Pat. No. 2,902,166 discloses a base separating member which is used to allow the assembly of filing and storing devices of various sizes and configurations through the additions of other parts to said separating member. Other U.S. patents which show organizing and filing devices and means for attaching them together or spacing them in a preselected configuration are shown in U.S. Pat. Nos. 2,023,150, 2,164,133, 2,751,088, and 3,269,547.

SUMMARY OF THE INVENTION

The present invention is summarized in that a modular desk organizer includes two organizing units each of which is one of a vertical organizing tray and a stacking horizontal sorting tray, each of the organizing units having provided along two opposite sides thereof of a pair of spaced, depending legs, the legs on the organizing units all being equal in length; and an adapter joining together the two organizing units, the adapter having a planar horizontal surface and having a pair of support shelves formed on opposite sides thereof, the support shelves having a pair of spaced apertures formed in them with one of the organizing units abutting each of the support shelves with the legs thereon extending through the apertures in the support shelves, the height of the support shelves being selected to correspond to the length of the legs on the organizing units so that the organizing units remain horizontally stable.

It is an object of the present invention to provide a desk organizer which is capable of organizing and separating files and papers of diverse types in a common modular unit.

It is a further object of the present invention to provide an adapter for use in such a modular desk organizer which allows organizing trays or file sorting devices of various types to be joined together in a common desk unit.

It is a general object of the present invention to provide a desk organizer which is easy to assemble into a customized configuration, which is efficient in its assembly and its operation, and which is economical to utilize.

Other objects, advantages, and features of the present invention will become apparent from the following specification, when taken in conjunction with the accompanying drawings.

DESCRIPTION OF THE PREFERRED EMBODIMENT

Figure 1:
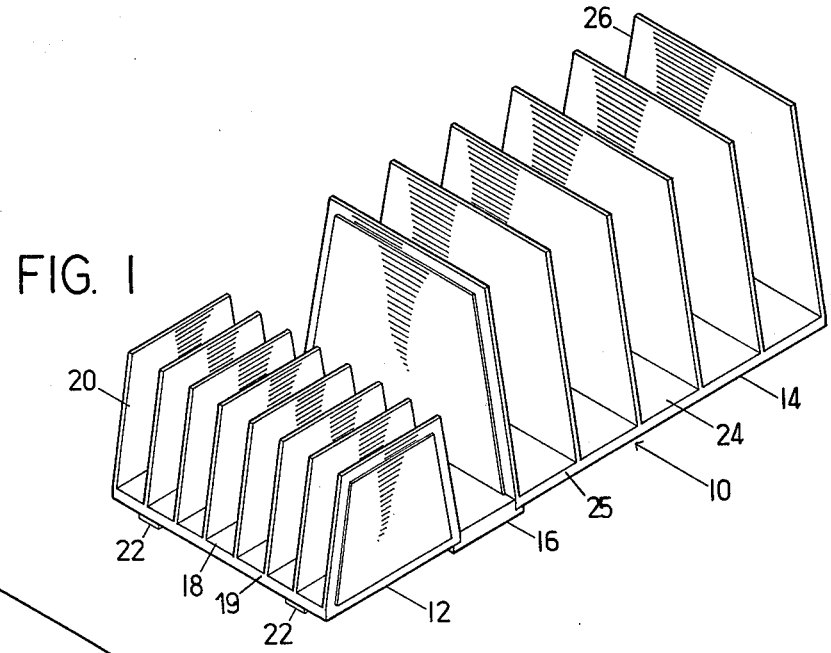
FIG. 1 is a perspective view of a modular desk organizer constructed in accordance with the present invention.

Shown in FIG. 1, and generally indicated at 10, is a modular desk organizer constructed in accordance with the present invention. The modular desk organizer 10 is an aid intended for an office desk and is designed to allow a user to effectively organize and sort differing sizes of files, envelopes, or papers in a common organizing unit in an efficient and rapid fashion. The desk organizer 10 of FIG. 1 includes generally three parts therein, a first organizing unit, here a small vertical sorting tray, indicated at 12, a second organizing unit, here a large vertical sorting tray, indicated at 14, and an adapter indicated at 16. All three major components of the modular desk organizer 10 are constructed of similar materials and are constructed so as to be pleasingly unified in color and general appearance.

The first organizing unit is a small vertical sorting tray 12 including a base 18 which is planar and rectangular in shape. A downwardly extending peripheral skirt 19 extends entirely around the periphery of the base 18. Upstanding from the base 18 are a plurality of dividers 20, each of which is vertically oriented and each of which is trapezoidal in shape, having a parallel top and base side and inwardly slanting side edges. The dividers 20 are equally spaced along the long axis of the rectangle of the base 18 of the sorting unit 12. A pair of legs 22, equal in length, depend from the base 18 along each of the long sides thereof and are located just inside of the peripheral skirt 19. Each of the pair of legs 22 on each of the long sides of the base 18 are separated by a common distance and are positioned in similar positions along the length of said sides of the base 18.

The second organizing unit is a large vertical sorting tray 14 generally similar to, although larger in scale than, the small vertical sorting tray 12. The large vertical sorting tray 14 includes a base 24 which is also planar and rectangular in shape which also has a peripheral skirt 25 extending downwardly from the edge thereof. The dimensions of the base 24 of the large vertical sorting unit 14 are selected so that the smaller side of the rectangle of the base 24 is the same length as the longer side of the rectangle of the base 18 of the small vertical sorting unit 12. Upstanding from the base 24 of the vertical sorting unit 14 are a plurality of dividers 26, each of which extends transversely across the base 24 and extends vertically upward therefrom. The dividers 26 are arranged in an equally spaced pattern along the length of the base 24. A pair of legs 28, which cannot be seen in FIG. 1, are provided at downwardly extending from each end of the base 24 of the large vertical sorting unit 14 just inside of the peripheral skirt 25. Each of the pair of legs 28 are sized so as to correspond exactly in size, position, and distance between them, to the legs 22 formed on the longer sides of the small vertical sorter 12. In contrast to the small vertical sorter 12, the legs 28 of the large vertical sorter 14 are located on the shorter sides of the rectangle of the base 24 of the vertical sorting unit 14.

Figure 2:
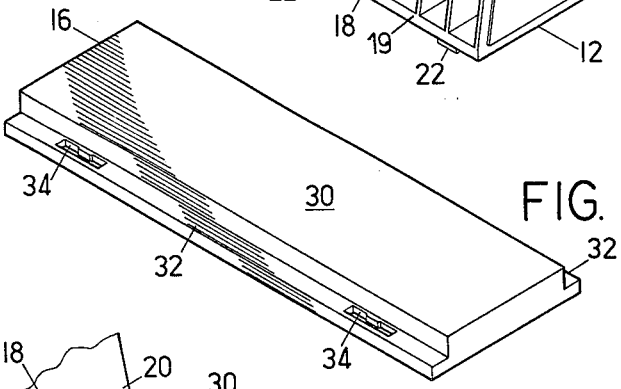
FIG. 2 is a perspective view of the desk unit adapter used in the modular desk organizer of FIG. 1.

The adapter 16 can be seen in more detail in the perspective view of FIG. 2. The adapter 16 includes a large, planar, rectangular, horizontal surface 30. The width of the horizontal surface 30 is selected so as to correspond to the exact distance by which it is desired to separate the organizing units which will be combined in the modular desk organizer. The horizontal surface 30 of the adapter 16 is coplanar with the horizontal bases 18 and 24 of the organizing units 12 and 14. Outwardly extending from each of the longer sides of the horizontal surface 30 of the adapter 16 is a respective support shelf 32. Each of the support shelves 32 is a lowered extension of the horizontal surface 30 and extends the full length of the adapter 16. Each of the support shelves 32 is constructed so that its height, by which it is meant the distance by which its top surface is separated from the bottom of the adapter 16, corresponds to the length of the legs 22 and 28 on the small and large vertical sorting units 12 and 14. Formed in the adapter 16 and extending through each of the support shelves 32 are a pair of apertures 34. The apertures 34 extend completely through the top surfaces of the support shelves 32 and are sized and positioned thereupon so as to generally correspond in size and position to the legs 22 and 28 formed in the small vertical adapter 12 and the large vertical supporting unit 14. The apertures 34 are spaced from the sides of the edge of the horizontal surface 30 by a distance equivalent to the distance by which the legs 22 and 28 are set back beneath the respective peripheral skirt 19 and 25.

In its operation, the modular desk organizer of FIG. 1 is intended to be an organizing unit which can sit upon an office desk and which is capable of sorting papers and files of varying sizes. Thus, for example, with reference to the organizing unit 10 of FIG. 1, the large vertical sorting tray 14 can be utilized for sizable files or large documents, while the small vertical sorting unit 12 can be utilized for envelopes, folded papers, or mail being sorted either upon receipt or for mailing. The adapter 16 allows both of the organizing units, in this case the large and small vertical sorting units 12 and 14, to be joined into a single modular desk organizer which is stable in its position upon the desk and unified in appearance.

It is the provision for the adapter 16 which allows the modular desk organizer of the present invention to function in an efficient fashion. The adapter 16 both separates the small vertical sorting unit 12 and the large vertical sorting unit 14 and joins the two organizing units into a fixed spatial relationship with each other as a common unit. The dimension of the width of the horizontal surface 30 of the adapter 16 is selected so as to correspond to the desired separation between the two organizing units which are joined into the modular desk organizer of FIG. 1. The adapter 16 is specifically intended to join the units together while at the same time interfering with the function of neither. Thus, it is an important feature of the adapter 16 that it does not lift either end of either of the organizing units to which it is attached, so that neither becomes unstable or wobbly upon the desk of the user. Thus, the height of the support shelves 32 on either side of the adapter 16 is specifically selected so as to correspond to the length of the legs 22 and 28 on the small vertical sorting unit 12 and the large vertical sorting unit 14.

Figure 3:
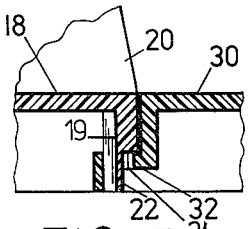
FIG. 3 is a cross-sectional view taken through the junction between the small vertical sorter and the adapter of FIG. 1.

The cross-sectional view of FIG. 3 illustrates, by showing as an example, a cross-sectional view of one of the legs 22 of the small vertical sorting unit 12 inserted into one of the apertures 34 in the adapter 16, the manner in which the adapter 16 interfits with the two organizing units. Note that the leg 22 rests firmly upon the surface onto which the assembled organizer is placed just as if the adapter unit 16 had not been there. Thus, both sides of each of the organizing units which are inserted into the adapter 16 rest firmly upon their legs, and the provision for the adapter 16 does not cause either of the units attached thereto to be tilted in any fashion. This ensures that the assembled organizing unit is sturdy and stable. Note also that the relative positioning of the leg 22 behind the peripheral skirt 19 and the aperture 34 on the support shelf 32 causes the peripheral skirt 19 to be in firm abutment with the edge of the horizontal surface 30 of the adapter 16. Thus, the leg 22 and skirt 19 are firmly held pinched between the aperture 34 and the edge of the horizontal surface 30 to tightly and securely attach the vertical sorter 12 to the adapter 16.

Figure 4:
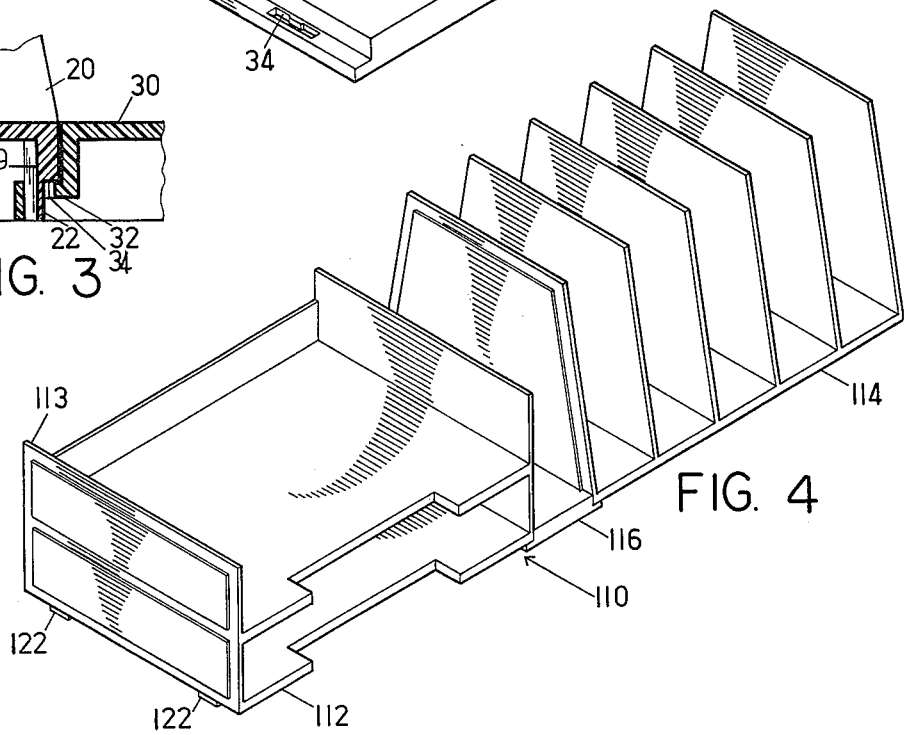
FIG. 4 is an alternative embodiment of the modular desk organizer constructed in accordance with the present invention and including the adapter therein.

Thus, it is the adapter 16 that joins the two organizing units 12 and 14 into a cohesive, unified desk organizer that is, for all purposes, the equivalent of a single unitary unit. The organizer 10 is also completely modular in character since the organizing units 12 and 14 can easily be replaced with any other type of organizing unit having a similar leg arrangement. For example, in FIG. 4, an alternative embodiment of the desk organizer, here designated 110, is illustrated. In the desk organizer 110 of FIG. 4, in which parts similar to the desk organizer 10 have been given similar numerals with 100 added thereto, the small vertical divider 12 has been replaced with a pair of stacked horizontal sorting units 112 and 113. The horizontal stacking units 112 and 113 are of a type in which the legs 122 can be inserted into receptacles on top of another unit so that the units can be stacked on one another, in the manner in which the horizontal sorting unit 113 is stacked on the horizontal stacking unit 112. One pair of the legs of the horizontal stacking unit 112 are, in turn, inserted into a pair of the apertures in the adapter 116 in the same fashion in which the legs 22 of the small vertical sorter 12 were inserted in the adapter 16.

It can be thus seen that one or more of the adapters 16 can be utilized to make any of a large number of possible configurations of desk organizers by combining various vertical or horizontal sorters into unified assemblies through the use of the adapter piece. Any such assembled desk organizer would have a unified appearance and would be a stable, tightly connected unit. The desk organizer of the present invention is thus completely modular in character in that individual sorting units can be substituted for each other or combined into units as desired by the particular user.

It is to be understood that the present invention is not limited to the particular arrangement and construction of parts illustrated herein, but embraces all such modified forms thereof as come within the scope of the following claims.

I claim:

1. A modular desk organizer comprising two organizing units (12, 14, 112, 114), each of which is one of a vertical sorting tray (12, 14, 114) and a horizontal sorting tray (112);

a downwardly extending peripheral skirt (19, 25) formed around the periphery of each organizing unit;

a pair of spaced, depending legs (22, 28, 122) provided along two opposite sides of each of the organizing units, the legs being positioned spaced inwardly of the peripheral skirt on the organizing unit and all of the legs on the organizing unit being equal in length;

an adapter (12) joining the two organizing units together and including a planar, rectangular, horizontal surface (30) extending between the two organizing units;

a pair of horizontal, planar support shelves (32) extending outwardly from the sides of the adapter (12) at a lever lower that the horizontal surface (3) and under the adjacent organizing units with the height of the support shelves (32) selected to correspond to the length of the legs on the organizing units so that the organizing units remain horizontal and rest firmly and evenly on all four of their legs (22, 28), each of the support shelves (32) having a pair of spaced apertures (34) formed therein to receive therethrough one pair of the legs of one of the organizing units, the apertures (34) being located in the support shelves so that the peripheral skirt on each of the organizing units is pressed against the horizontal surface of the adapter and rests on top of the support shelf (32) so that the adapter is securely attached to the organizing units.

2. A modular desk organizer as claimed in claim 1 wherein each of the organizing units includes a horizontal base (18, 25) which is coplanar with the horizontal surface (30) of the adapter (12) when the organizing units are joined to the adapter (12).

* * * * *